US007813666B2

(12) United States Patent
Sato

(10) Patent No.: US 7,813,666 B2
(45) Date of Patent: Oct. 12, 2010

(54) PROCESS UNIT, IMAGE FORMATION APPARATUS, AND DEVELOPING CARTRIDGE

(75) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 256 days.

(21) Appl. No.: 12/022,401

(22) Filed: Jan. 30, 2008

(65) Prior Publication Data

US 2008/0310881 A1 Dec. 18, 2008

(30) Foreign Application Priority Data

Jan. 30, 2007 (JP) ..... 2007-019862

(51) Int. Cl.
*G03G 15/00* (2006.01)
*G03G 21/16* (2006.01)

(52) U.S. Cl. ..... 399/90; 399/111

(58) Field of Classification Search ..... 399/90, 399/111, 113, 119; 347/140
See application file for complete search history.

(56) References Cited

U.S. PATENT DOCUMENTS

| | | | | |
|---|---|---|---|---|
| 5,899,753 | A | 5/1999 | Wong et al. | |
| 6,041,203 | A | 3/2000 | Suzuki et al. | |
| 6,330,410 | B1 | 12/2001 | Okabe et al. | |
| 6,411,789 | B1 | 6/2002 | Okabe et al. | |
| 6,411,794 | B1 * | 6/2002 | Muto | 399/90 X |
| 6,546,217 | B2 | 4/2003 | Okabe et al. | |
| 6,594,454 | B2 * | 7/2003 | Oguma et al. | 399/90 |
| 6,690,903 | B2 | 2/2004 | Okabe et al. | |
| 6,873,810 | B2 | 3/2005 | Okabe et al. | |
| 6,934,485 | B2 * | 8/2005 | Miyabe et al. | 399/90 |
| 7,218,878 | B2 | 5/2007 | Okabe et al. | |
| 7,224,923 | B2 | 5/2007 | Okabe et al. | |
| 7,231,167 | B2 | 6/2007 | Okabe et al. | |
| 7,245,850 | B2 | 7/2007 | Okabe et al. | |
| 2007/0003311 | A1 | 1/2007 | Sato | |

FOREIGN PATENT DOCUMENTS

| | | |
|---|---|---|
| CN | 1892513 | 1/2007 |
| EP | 1621942 | 2/2006 |
| JP | 09-190083 | 7/1997 |
| JP | 09-325667 | 12/1997 |
| JP | 2000-250378 | 9/2000 |
| JP | 2001-215860 | 8/2001 |
| JP | 2004-252179 | 9/2004 |

OTHER PUBLICATIONS

Search report for EP Application No. 08001430.1-2209, dated May 26, 2008.
Notification of Reason for Refusal, Japanese Patent Application No. 2007-019862, Reference No. 2005-13046, Dispatch No. 702237, Dispatched Nov. 20, 2008.
Office Action corresponding to Chinese Application No. 2008100054152 mailed Jun. 19, 2009.

* cited by examiner

*Primary Examiner*—Sandra L Brase
(74) *Attorney, Agent, or Firm*—Banner & Witcoff, Ltd

(57) ABSTRACT

When a developing cartridge is accommodated in an accommodating section of a process unit casing, an electrode of the developing cartridge for inputting a bias to a developer carrier enters an engagement portion of the process unit casing to be engaged with and fixed to the engagement portion. A joint member joins the electrode to a developing cartridge casing so that the developing cartridge casing is movable relative to the process unit casing in a state in which the electrode is engaged with and fixed to the engagement portion.

10 Claims, 10 Drawing Sheets

PROCESS UNIT, IMAGE FORMATION APPARATUS, AND DEVELOPING CARTRIDGE

CROSS REFERENCE TO RELATED APPLICATION

The present disclosure relates to the subject matter contained in Japanese patent application No. 2007-019862 filed on Jan. 30, 2007, which is expressly incorporated herein by reference in its entirety.

TECHNICAL FIELD

This invention relates to an image formation apparatus such as a laser printer, and a process unit and a developing cartridge which are mountable to the image formation apparatus.

BACKGROUND ART

JP-A-2000-250378 discloses an image formation apparatus, and a process unit including a developing cartridge and a photoconductor cartridge. The developing cartridge is detachably mounted to the photoconductor cartridge to form the process unit. The process unit is detachably mounted to the image formation apparatus.

More specifically, the developing cartridge has a developing roller and an operated section. The photoconductor cartridge has a photoconductor drum, a slide support member, and a move operation section. A housing of the image formation apparatus has a guide.

When the developing cartridge is mounted to the photoconductor cartridge, the developing roller is located close to the photoconductor drum and the operated section is located adjacent the slide support member. When the process unit is mounted to the apparatus housing, the move operation section comes in sliding contact with the guide to change the attitude of the slide support member. The slide support member correspondingly presses the operated section to press the developing roller against the photoconductor drum.

Because the image formation apparatus is required to apply a developing bias to the developing roller, an electrode is provided on the apparatus housing, so that when the process unit is mounted to the apparatus housing, the electrode is brought into contact with and electrically connected to a shaft of the developing roller to apply the developing bias to the developing roller.

On one hand, in order to keep the image quality, it is required to press the developing roller against the photoconductor drum uniformly in the axial direction. On the other hand, because vibrations occur due to rotation of the photoconductor drum during image formation, it is required to permit slight movement of the developing cartridge relative to the photoconductor cartridge to follow and absorb such vibrations. However, in a case in which the developing roller shaft and the apparatus housing electrode are contacted with each other to apply the developing bias to the developing roller, the slight movement of the developing cartridge relative to the photoconductor cartridge may result in an unstable contact between the developing roller shaft and the apparatus housing electrode, i.e. an unstable supply of the developing bias to the developing roller. In this connection, if contact pressure between the developing roller shaft and the apparatus housing electrode is increased in an attempt to make the contact therebetween stable, the developing cartridge cannot sufficiently follow vibrations caused by rotation of the photoconductor drum to undesirably degrade the image quality.

SUMMARY

The present invention provides, as one of illustrative, non-limiting embodiments, a process unit comprising: a first casing having a photoconductor on which an electrostatic latent image can be formed; and a developing cartridge having a developer carrier for carrying a developer to develop the electrostatic latent image. The developing cartridge is detachably mountable to the first casing.

The first casing comprises: a first accommodating section for accommodating the developing cartridge so that the developer carrier is confronted with the photoconductor in a first direction. The first accommodating section has an engagement portion.

The developing cartridge comprises: a first electrode which enters the engagement portion in a second direction intersecting the first direction to be engaged with and fixed to the engagement portion when the developing cartridge is accommodated in the first accommodating section, and which can inputs a bias to the developer carrier; a second casing which supports the developer carrier, and which is movable relative to the first electrode in the first direction when the developing cartridge is accommodated in the first accommodating section; and a joint member which joins the first electrode to the second casing, and which urges the first electrode toward the engagement portion when the developing cartridge is accommodated in the first accommodating section.

Accordingly, one of advantages of the present invention is to provide an arrangement which can stably supply a developing bias. Another one of advantages is to provide an arrangement which can permit a movement of the developer carrier relative to the photoconductor.

These and other advantages of the present invention will be discussed in detail in the following description with reference to the accompanying drawings.

DESCRIPTION OF THE PREFERRED EMBODIMENT

Illustrative, non-limiting embodiments of this invention will be discussed in detail with reference to the accompanying drawings.

1. Configuration of Laser Printer

Figure 1:
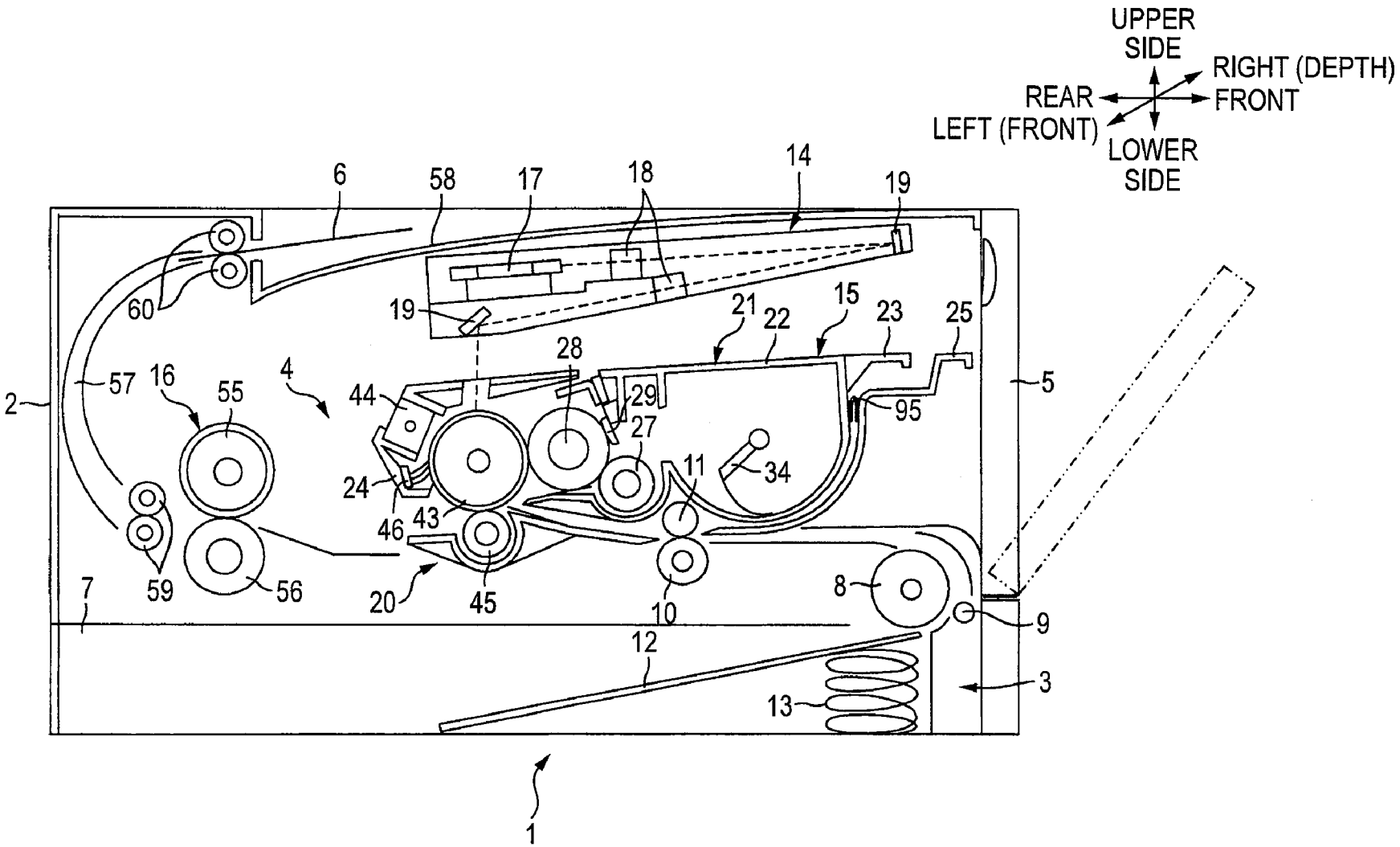
FIG. 1 is a sectional side view of a main part to show a laser printer as an example of an image formation apparatus of the invention.
Figure 2:
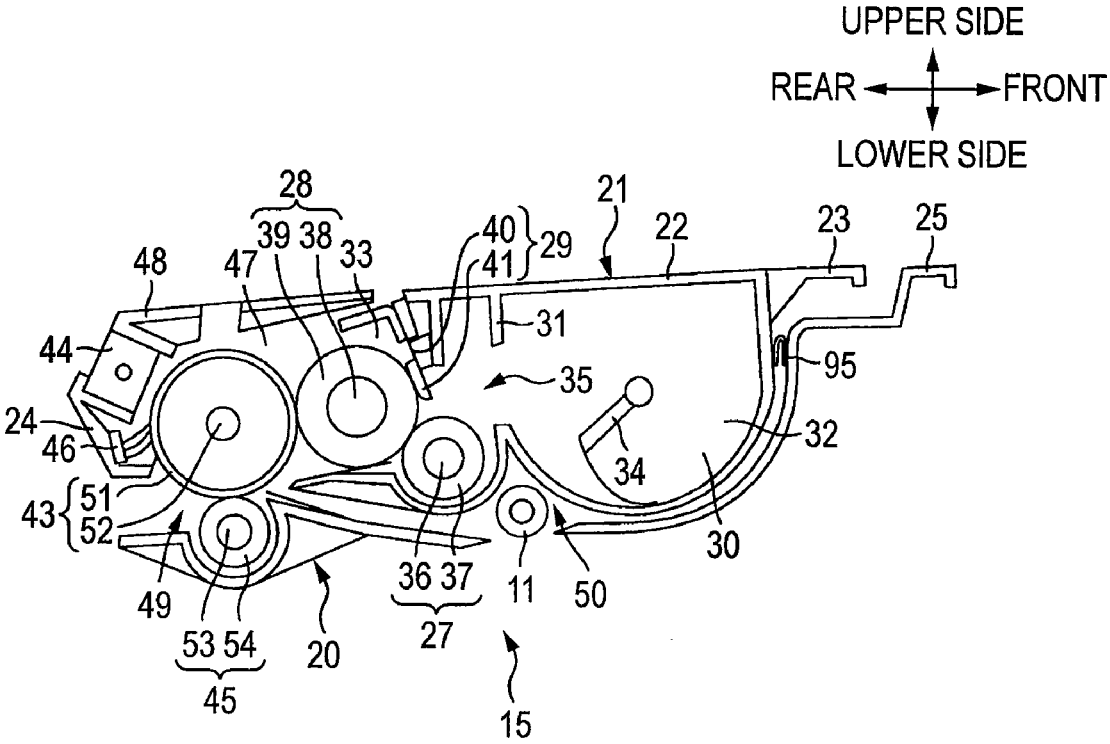
FIG. 2 is a sectional side view of a main part of a process unit of the laser printer shown in FIG. 1.

FIG. 1 is a sectional side view of a main part to show a laser printer as an example of an image formation apparatus of the invention. FIG. 2 is a sectional side view of a main part of a process unit of the laser printer shown in FIG. 1.

As shown in FIG. 1, a laser printer 1 includes an apparatus casing 2 as an example of a casing. The laser printer 1 further includes a feeder section 3 and an image formation section 4, both provided in the apparatus casing 2.

1) Apparatus Casing

The apparatus casing 2 has a front cover 5 on one of side walls. The lower end part of the front cover 5 is rotatably supported on the side wall through a hinge. When the front cover 5 is opened with the lower end part of the front cover 5 as a fulcrum, the internal space of the apparatus casing 2 is opened so that a process unit accommodating section 77 (described later) as an example of a second accommodating section is exposed. In this state, a process unit 15 (described later) can be attached to and detached from the process unit accommodating section 77 of the apparatus casing 2. When the front cover 5 is closed with the lower end part of the front cover 5 as the fulcrum, the internal space of the apparatus casing 2 is closed.

In the description to follow, as for the laser printer 1 and the process unit 15, the side where the front cover 5 is provided is "front" and the opposite side is "rear." The side closer to a reader in the paper thickness direction of Figures is "left" and the side farther from the reader in the paper thickness direction of Figures is "right." Further, "width direction" is the same direction as "right and left direction." These directions are only for ease of explanation, and are not intended to limit this invention.

2) Feeder Section

The feeder section 3 is provided for feeding a sheet 6 to the image formation section 4. The feeder section 3 is disposed in the bottom of the apparatus casing 2. The feeder section 3 includes a sheet feed tray 7, a sheet feed roller 8, a pinch roller 9, a lower registration roller 10, and an upper registration roller 11.

The sheet feed tray 7 is detachably mounted to the bottom of the apparatus casing 2. The sheet feed tray 7 has a paper press plate 12 on which the sheets 6 are to be stacked. The front end part of the paper press plate 12 is urged toward the sheet feed roller 8 by a spring 13.

The sheet feed roller 8 is provided above the front end part of the sheet feed tray 7. The pinch roller 9 is provided in front of the sheet feed roller 8. The lower registration roller 10 and the upper registration roller 11 are provided at the rear of the sheet feed roller 8, and are opposed to each other in an up and down direction. The lower registration roller 10 is rotatably supported on the apparatus casing 2. The upper registration roller 11 is rotatably supported on a drum casing 24 (described later).

The uppermost one of the sheets 6 stacked on the paper press plate 12 is fed one-by-one from the stacked sheets 6 by the action of rotation of the sheet feed roller 8. The sheet 6, thus fed by the sheet feed roller 8, passes between the sheet feed roller 8 and the pinch roller 9 and is transported to the nip between the lower registration roller 10 and the upper registration roller 11.

The sheet 6 nipped by the lower registration roller 10 and the upper registration roller 11 is registered in timing, and then is transported to a transfer position. The transfer position is a nip position between a photoconductive drum 43 (described later) and a transfer roller 45 (described later).

3) Image Formation Section

The image formation section 4 includes a scanner unit 14, a process unit 15, and a fixing unit 16.

3-1) Scanner Unit

The scanner unit 14 is provided in an upper part of the apparatus casing 2. The scanner unit 14 includes a laser light source (not shown), a polygon mirror 17, two lenses 18, and two reflecting mirrors 19.

A laser beam based on image data is emitted from the laser light source. As indicated by the dotted line in FIG. 1, the beam is deflected by the polygon mirror 17, passes through one of the lenses 18, is bent by one of the reflecting mirrors 19, passes through the other of the lenses 18 and then is again bent by the other of the reflecting mirrors 19, so that the beam is irradiated onto the surface of the photoconductive drum 43.

3-2) Process Unit

The process unit 15 is detachably mounted to the apparatus casing 2 so as to be located below the scanner unit 14.

As shown in FIG. 2, the process unit 15 includes a developing cartridge 21 and a drum cartridge 20 to which the developing cartridge 21 is detachably mounted.

a) Developing Cartridge

The developing cartridge 21 includes a developing casing 22 as an example of a second casing. The developing cartridge 21 further includes a supply roller 27, a developing roller 28, and a layer thickness regulation blade 29, all of which are provided in the developing casing 22.

The developing casing 22 has two side walls 30 which are spaced apart from and confronted with each other in a width direction and which are examples of a pair of side plates. The developing casing 22 is formed into a substantially box like shape having an opening at the rear side thereof. The front end part of the developing casing 22 has a forwardly projected gripper 23. The developing casing 22 has a partition plate 31 at a midpoint in a front and rear direction.

The front space of the developing casing 22 is partitioned as a toner storage chamber 32 by the partition plate 31. The rear space of the developing casing 22 is partitioned as a developing chamber 33 by the partition plate 31.

The toner storage chamber 32 stores positively chargeable, nonmagnetic single component toner as a developer. An agitator 34 is provided in the toner storage chamber 32.

The supply roller 27, the developing roller 28, and the layer thickness regulation blade 29 are provided in the developing chamber 33.

The supply roller 27 is provided at the rear of an opening 35. The supply roller 27 includes a supply roller shaft 36 made of metal, and an electrically conductive sponge roller 37 covering the periphery of the supply roller shaft 36. The supply roller shaft 36 is rotatably supported on side walls 30 of the developing casing 22. Axial end parts of the supply roller shaft 36 respectively project from the side walls 30 to the outside in the width direction i.e., right and left direction (see FIG. 3). A developing bias is applied to the supply roller shaft 36 from a conductive plate 63 (described later) during development.

The developing roller 28 is disposed at the rear of the supply roller 27. The developing roller 28 includes a developing roller shaft 38 made of metal, and an electrically conductive rubber roller 39 covering the periphery of the developing roller shaft 38. Axial (longitudinal) end parts of the developing roller shaft 38 is rotatably supported on the side walls 30 of the developing casing 22. The axial end parts of the developing roller shaft 38 respectively project from the side walls 30 to the outside in the width direction, i.e. right and left direction (see FIG. 3). A developing bias is applied to the developing roller shaft 38 from the conductive plate 63 during development.

The supply roller 27 and the developing roller 28 are disposed so that the sponge roller 37 and the rubber roller 39 are mutually compressed.

The layer thickness regulation blade 29 includes a blade 40 made of a plate spring member, and a press part 41 made of insulative silicone rubber. One end part of the blade 40 is supported on an upper wall of the developing casing 22 above the developing roller 28. An opposite end part of the blade 40 is provided with the press part 41. The press part 41 is pressed against the surface of the developing roller 28 by an elastic force of the blade 40.

b) Drum Cartridge

The drum cartridge 20 includes the drum casing 24 as a first casing. The drum cartridge 20 further includes a photoconductive drum 43 as an example of a photoconductor, a scorotron type charger 44, a transfer roller 45, and a conductive brush 46, all of which are provided in the drum casing 24.

The drum casing 24 has two side walls 47 spaced apart from and confronted with each other in a width direction, and is formed into a substantially box-like shape having an opening at the upper side. The front end part of the drum casing 24 has a forwardly projected gripper 25. The drum casing 24 has a top cover 48 on the rear. The rear space of the drum casing 24 is partitioned as a transfer section 49, the upper side of which is closed by the top cover 48. The front space of the drum casing 24 is partitioned as a developing cartridge accommodating section 50, the upper side of which is opened. The developing cartridge accommodating section 50 is as an example of a first accommodating section.

The developing cartridge accommodating section 50 is configured to accommodate the developing casing 22 therein so that the developing cartridge 21 can be detachably mounted to the drum cartridge 20. When the developing casing 22 is accommodated within the developing cartridge accommodating section 50, the developing roller 28 is confronted with the photoconductive drum 43 in the front and rear direction.

The photoconductive drum 43, the scorotron type charger 44, the transfer roller 45, and the conductive brush 46 are provided in the transfer section 49.

When the developing cartridge 21 is accommodated in the developing cartridge accommodating section 50, the photoconductive drum 43 is disposed at the rear of the developing roller 28. The photoconductive drum 43 includes a tubular drum base 51 and a metal drum shaft 52. The outermost surface layer of the drum base 51 is formed of a positively chargeable, photosensitive layer.

The drum shaft 52 is disposed concentric to the axis of the drum base 51. The drum shaft 52 is non-rotatably supported on the side walls 47 of the drum casing 24. Axial end parts of the drum shaft 52 respectively project from the side walls 47 to the outside in the width direction (see FIG. 5).

The drum base 51 is supported by the drum shaft 52 so that drum base 51 is rotatable about the axis of the drum shaft 52 in the drum casing 24.

The scorotron type charger 44 is supported on the top cover 48 so as to be located at an obliquely upper and rear side of the photoconductive drum 43. The scorotron type charger 44 is spaced apart from and confronted with the photoconductive drum 43 so as not to come in contact with the photoconductive drum 43. The scorotron type charger 44 in this example generates corona discharge for positive charge.

The transfer roller 45 is disposed below the photoconductive drum 43. The transfer roller 45 includes a transfer roller shaft 53 made of metal, and an ionic conductive rubber roller 54 covering the periphery of the transfer roller shaft 53. The transfer roller shaft 53 is rotatably supported on the side walls 47 of the drum casing 24. A transfer bias is applied to the transfer roller shaft 53 during transfer. The rubber roller 54 is pressed against the drum base 51 from below. Accordingly, a nip is formed between the photoconductive drum 43 and the transfer roller 45.

The conductive brush 46 is disposed at the rear of the photoconductive drum 43, and confronted with the photoconductive drum 43. The conductive brush 46 is supported on the top cover 48 so that the tip of the brush 46 comes in contact with the surface of the drum base 51.

c) Developing and Transfer Operation

Toner stored in the toner storage chamber 32 is agitated by the agitator 34, and is supplied from the opening 35 below the partition plate 31.

The toner supplied from the opening 35 is supplied to the developing roller 28 by rotation of the supply roller 27. At this time, the toner is frictionally charged positively between the sponge roller 37 and the rubber roller 39. Subsequently, the toner enters between the rubber roller 39 and the press part 41 by rotation of the developing roller 28, and is carried on the surface of the rubber roller 39 as a thin layer of a given thickness.

On the other hand, the surface of the photoconductive drum 43 is uniformly charged positively by the scorotron type charger 44. Subsequently, the surface of the photoconductive drum 43 is exposed by a scanning laser beam of the scanner unit 14. The exposure portion of the uniformly charged surface of the photoconductive drum 43 is lowered in potential. Consequently, an electrostatic latent image based on image data is formed on the surface of the photoconductive drum 43.

Next, when the toner carried on the surface of the developing roller 28 is opposed to the photoconductive drum 43 by rotation of the developing roller 28, the toner is supplied to the electrostatic latent image formed on the surface of the photoconductive drum 43. Consequently, the toner is selectively carried on the electrostatic latent image, i.e. the exposure portion, so that the electrostatic latent image is developed as the toner image carried on the surface of the photoconductive drum 43.

Subsequently, the photoconductive drum 43 and the transfer roller 45 are rotated so as to nip and transport a sheet 6. When the sheet 6 passes through the nip between the photoconductive drum 43 and the transfer roller 45, the toner image carried on the surface of the photoconductive drum 43 is transferred to the surface of the sheet 6.

After the transfer, paper powder deposited on the surface of the photoconductive drum 43 due to contact with the sheet 6 is removed therefrom by the conductive brush 46 in association with subsequent rotation of the photoconductive drum 43.

3-3) Fixing Unit

The fixing unit 16 is provided at the rear of the process unit 15 as shown in FIG. 1. The fixing unit 16 includes a heating roller 55 and a pressurization roller 56. The heating roller 55 includes a metal tube and a halogen lamp disposed on and along the axis of the metal tube. The pressurization roller 56 is disposed below the heating roller 55 to press the heating roller 55 from below.

The fixing unit 16 thermally fixes the toner transferred to the surface of the sheet 6 while the sheet 6 passes through the nip between the heating roller 55 and the pressurization roller 56.

A sheet ejection path 57 is provided at the rear of the fixing unit 16 to extend in the up and down direction toward the upper face of the apparatus casing 2. A sheet ejection tray 58 is formed on the upper face of the apparatus casing 2. Transport rollers 59 are provided in the upstream end part of the sheet ejection path 57, and sheet ejection rollers 60 are provided in the downstream end part of the sheet ejection path 57.

The paper 6 with the toner fixed thereon is transported along the sheet ejection path 57 by the transport rollers 59, and is ejected onto the sheet ejection tray 58 by the sheet ejection rollers 60.

2. Configuration for Applying of Developing Bias

Figure 3:
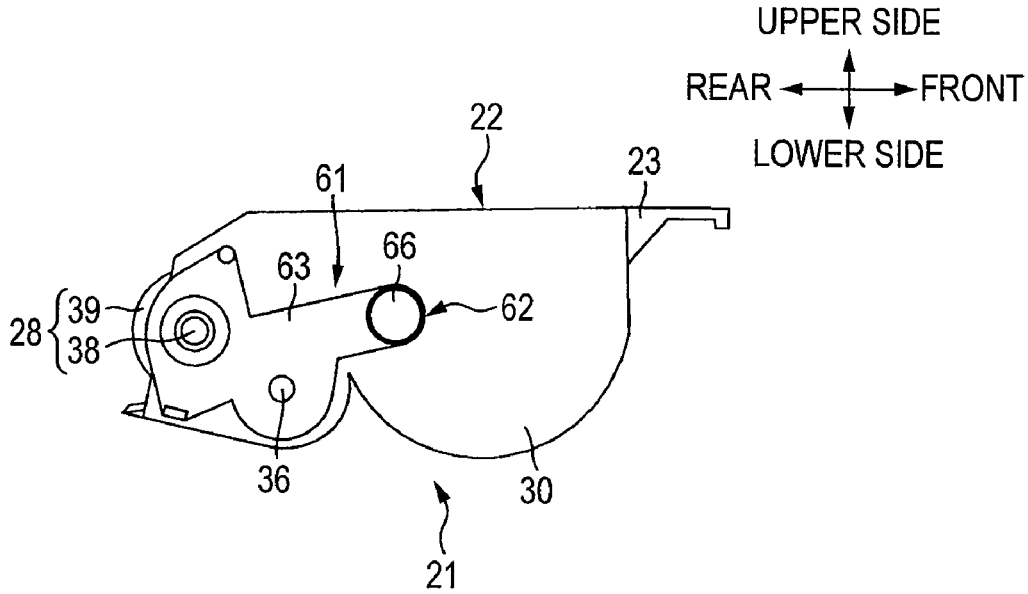
FIG. 3 is a left side view of a developing cartridge.
Figure 4:
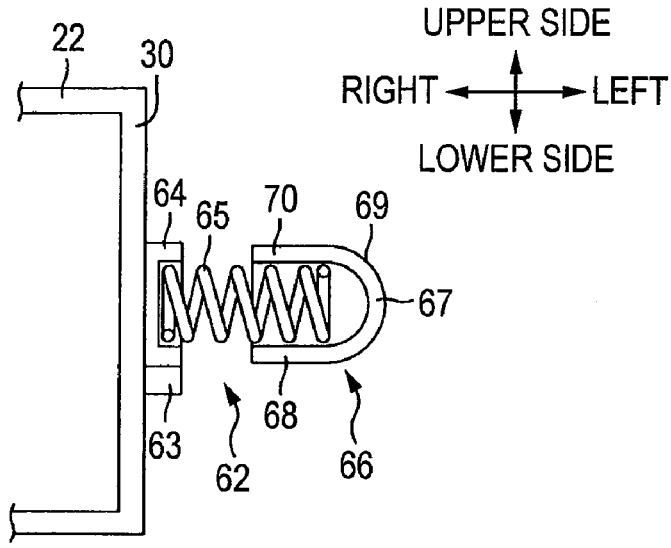
FIG. 4 is a sectional view in a width direction of the developing cartridge shown in FIG. 3 to show a developing electrode section.
Figure 5:
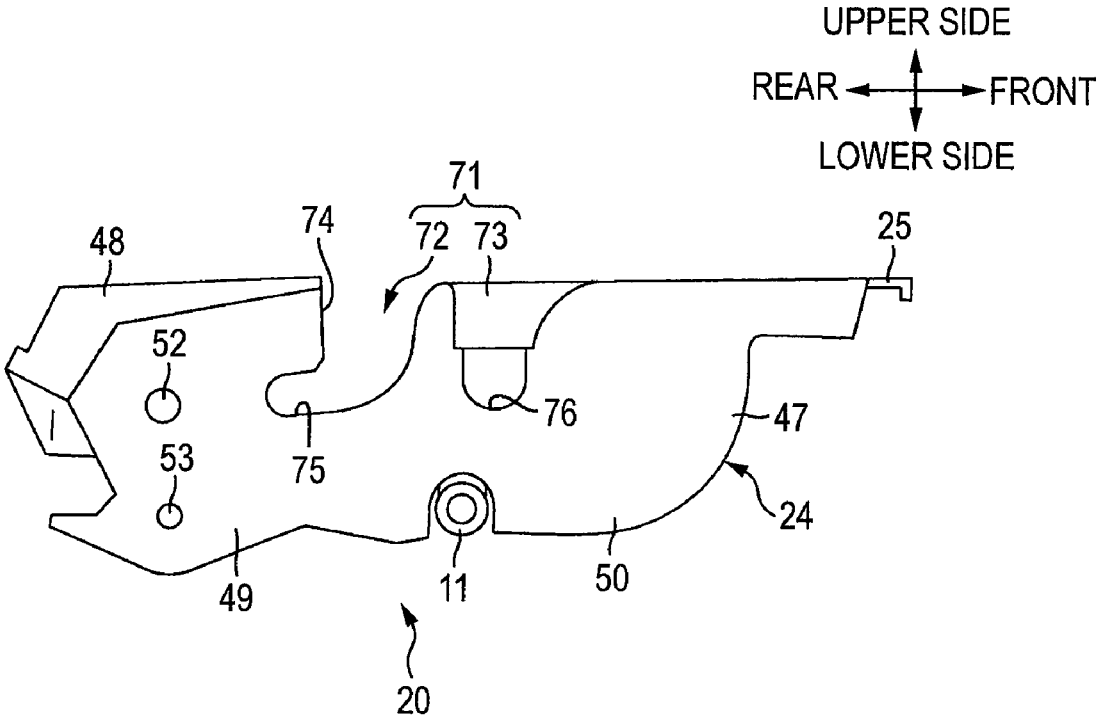
FIG. 5 is a left side view of a drum cartridge.
Figure 6:
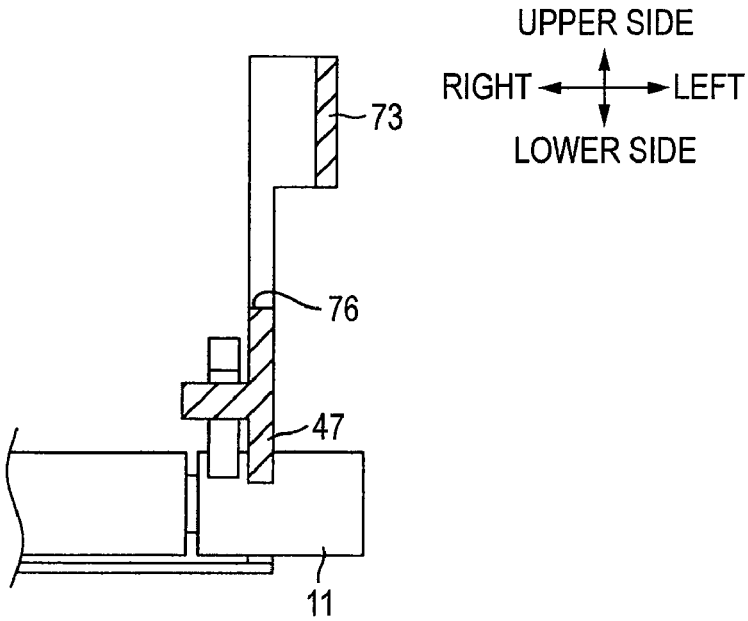
FIG. 6 is a sectional view in a width direction of the drum cartridge shown in FIG. 5 to show an electrode guide part.
Figure 7:
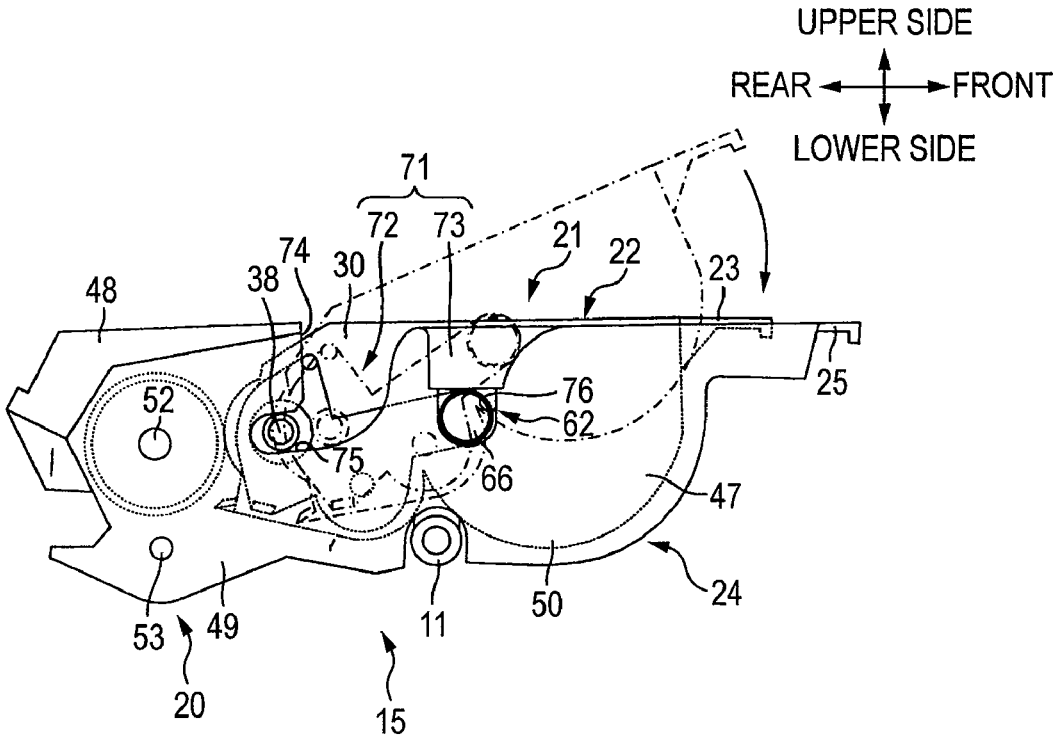
FIG. 7 is a left side view of the process unit.
Figure 8:
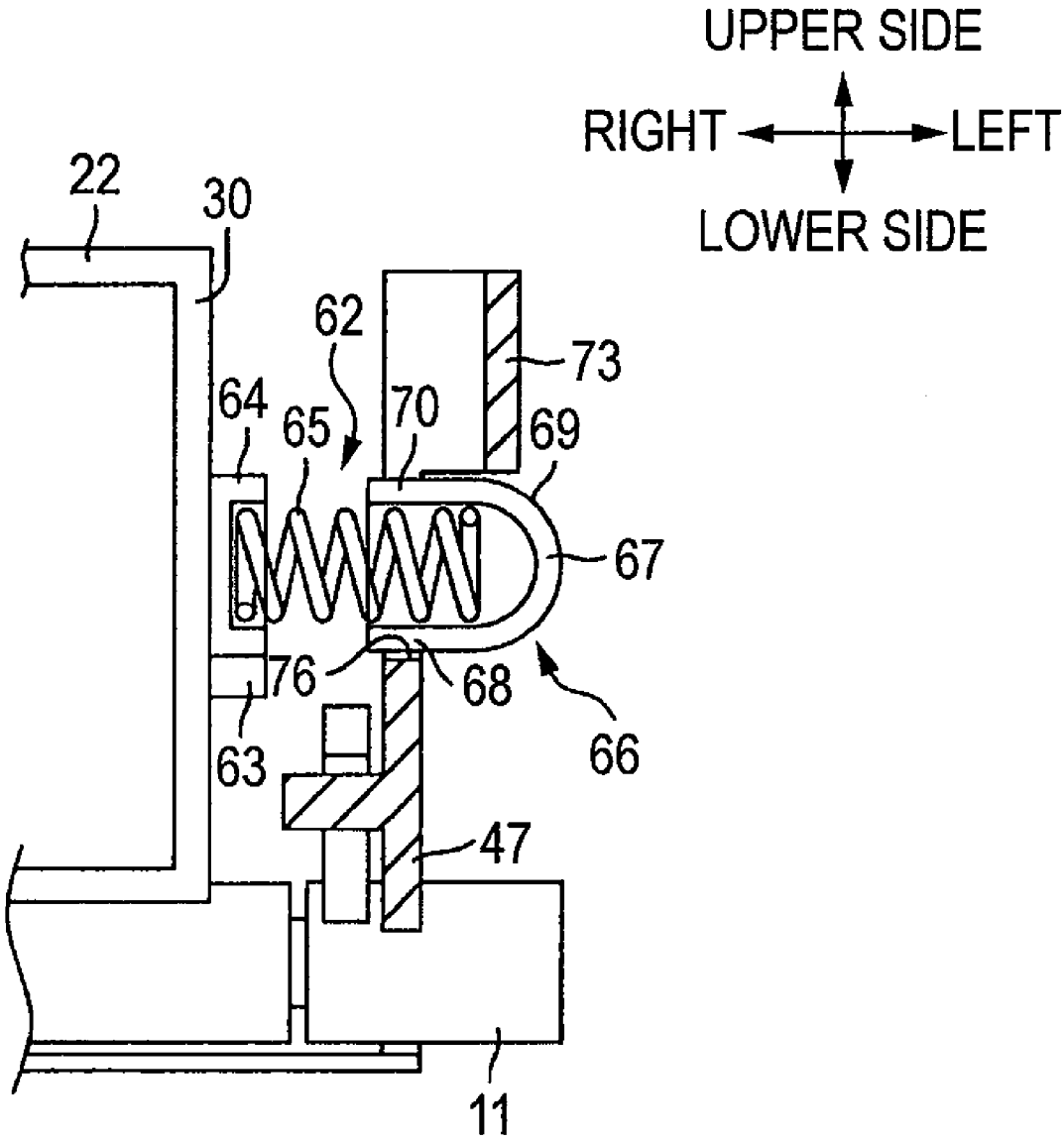
FIG. 8 is a sectional view in a width direction of the process unit shown in FIG. 7 to show the developing electrode section and the electrode guide part.
Figure 9:
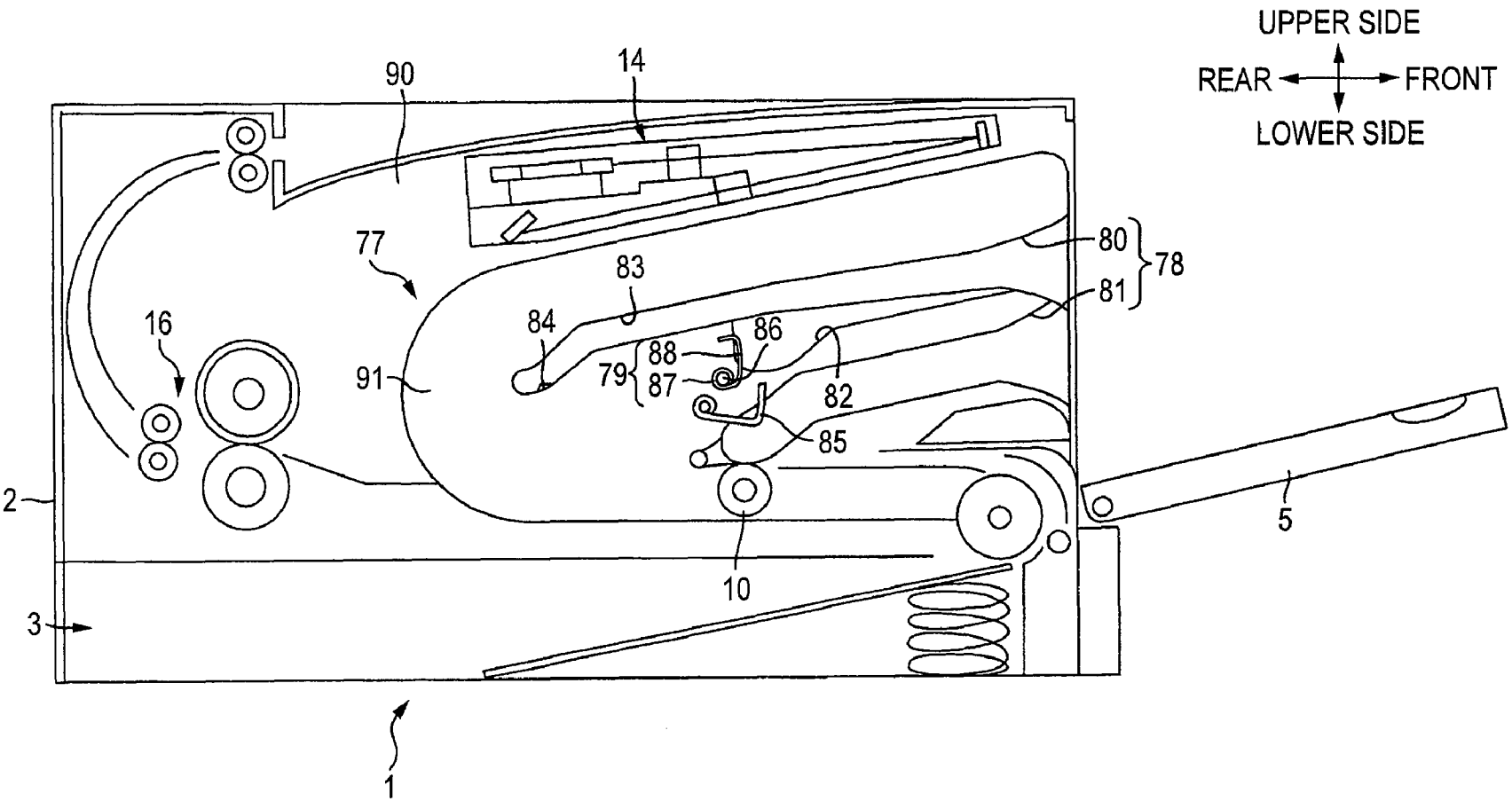
FIG. 9 is a side view of a main part of an apparatus casing (in a state in which the process unit is not mounted).
Figure 10:
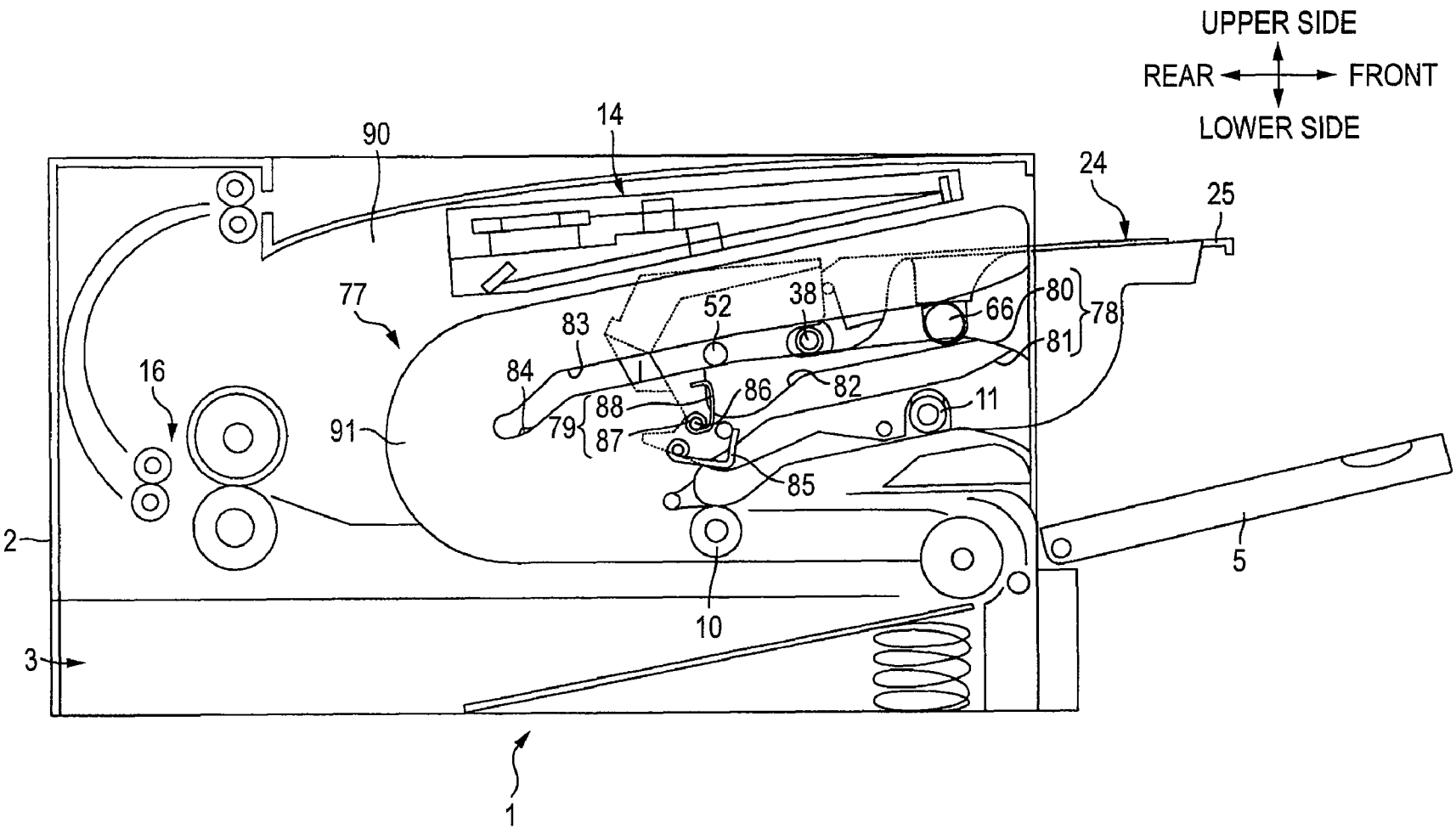
FIG. 10 is a side view of the main part of the apparatus casing (in a state in which the process unit is being mounted).
Figure 11:
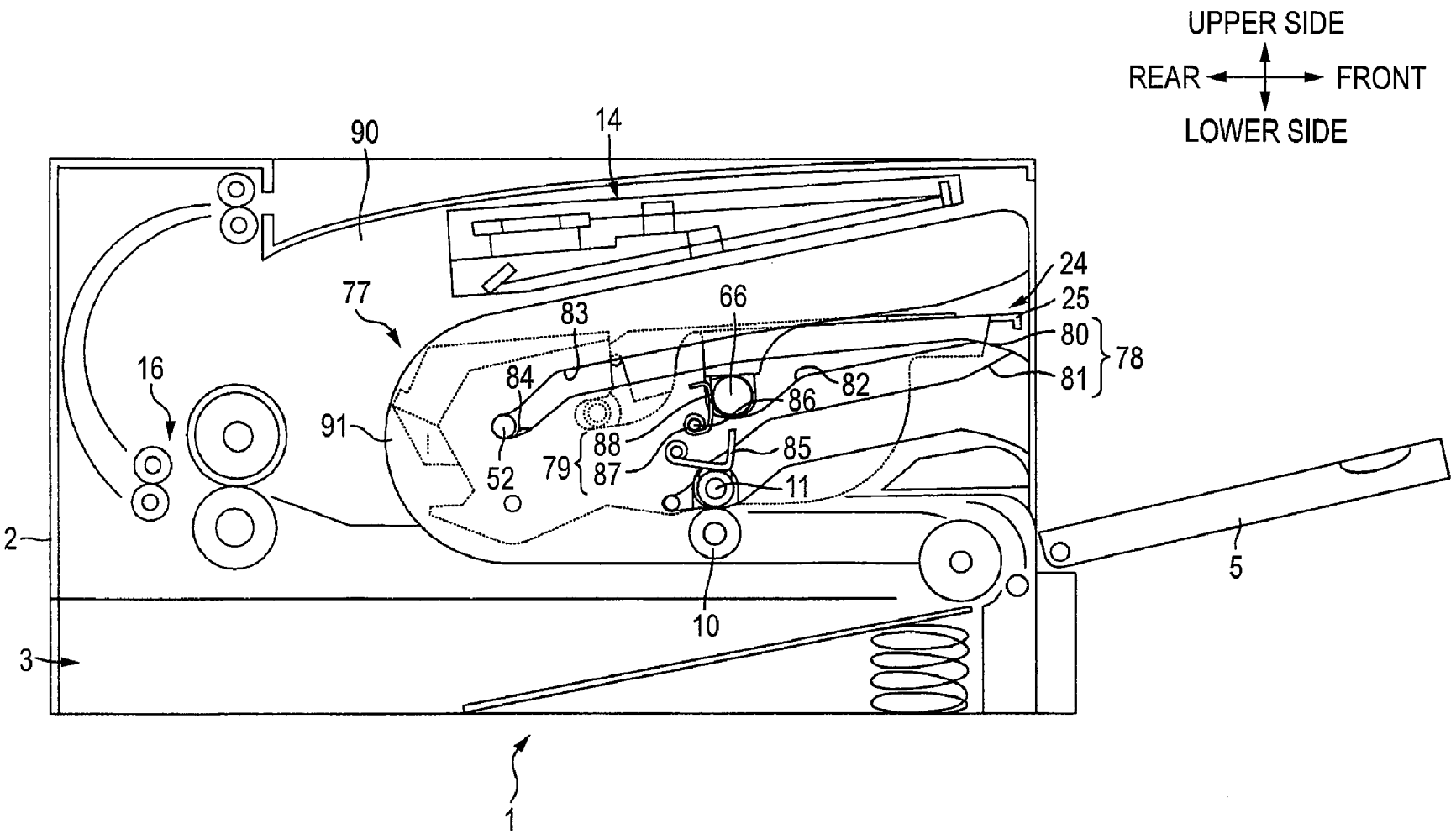
FIG. 11 is a side view of the main part of the apparatus casing (in a state in which the process unit has been completely mounted).
Figure 12:
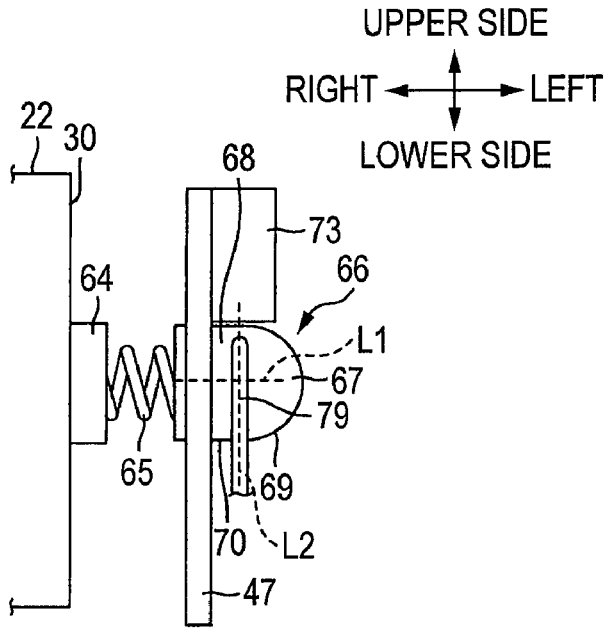
FIG. 12 is a rear view of a contact part and an apparatus electrode in a state of FIG. 11.

FIG. 3 is a left side view of the developing cartridge. FIG. 4 is a sectional view of the developing cartridge shown in FIG. 3 in a width direction to show a developing electrode section. FIG. 5 is a left side view of the drum cartridge. FIG. 6 is a sectional view of the drum cartridge shown in FIG. 5 in a width direction to show an electrode guide part. FIG. 7 is a left side view of the process unit. FIG. 8 is a sectional view of the process unit shown in FIG. 7 in a width direction to show the developing electrode section and the electrode guide part. FIG. 9 is a side view of a main part of the apparatus casing (in a state in which the process unit is not mounted). FIG. 10 is a side view of the main part of the apparatus casing (in a state in which the process unit is being mounted). FIG. 11 is a side view of the main part of the apparatus casing (in a state in which the process unit has been completely mounted). FIG. 12 is a rear view of a contact part and an apparatus electrode in FIG. 11. In FIGS. 9 to 11, to simplify the description, the members are shown as projection views projecting in a right and left direction from the right inside to the left outside.

1) Developing Cartridge

As shown in FIGS. 3 and 4, the developing casing 22 includes a developing power supply section 61 for inputting a developing bias to the supply roller 27 and the developing roller 28. The developing power supply section 61 includes a developing electrode section 62 and the conductive plate 63.

1-1) Developing Electrode Section

As shown in FIG. 3, the developing electrode section 62 is disposed at the left outside portion of the developing casing 22, and is supported by the left side wall 30 (an example of one of side plates). The developing electrode section 62 is located in front of the developing roller shaft 38. More specifically, the developing electrode section 62 is spaced apart from and confronted with the axial end part of the developing roller shaft 38.

As shown in FIG. 4, the developing electrode section 62 includes a spring receiver 64, a spring 65 (an example of a joint member), and a contact part 66 (an example of a first electrode).

The spring receiver 64 is formed of a conductive material into a cylindrical shape. The spring receiver 64 is integrally provided on the left side wall 30 so as to project from the surface of the left side wall 30 to the left.

The spring 65 is a compression spring in the form of a coil, and is formed of a conductive material. One end part of the spring 65 is press-fitted and thus fixed to the spring receiver 64.

The contact part 66 is formed of a conductive material, and has a substantially U-shape in cross section. The contact part 66 includes a cylindrical base end contact part 68 and a hemispherical tip insertion part 67 integral with the contact part 68.

The tip insertion part 67 is formed on the left end part of the base end contact part 68 so as to be smoothly continuous from the left end part of the base end contract part 68. The surface of the tip insertion part 67 is formed as a slope surface 69 (hemispherical surface in this example) such that the surface is curved from the outermost peripheral end of the tip insertion part 67 toward the center thereof as it goes from the right to the left. The surface of the base end contract part 68 is formed as a contact surface 70 extending along the right and left direction. In this example, the peripheral length of the slope surface 69 as defined in an imaginary plane orthogonal to an axis of the contact part 66 is gradually decreased as the slope surface 69 goes from the right to the left, and the contact surface 70 is concentric and parallel to the axis of the contact part 66. The contact surface 70 contains an imaginary straight line L1 which is parallel to the urging direction of the spring 65.

An opposite end part of the spring 65 is press-fitted and thus fixed to the base end contact part 68. Accordingly, the contact part 66 and the spring receiver 64 are joined and electrically connected together by the spring 65. Flexibility of the spring 65 permits a movement of the contact part 66 relative to the spring receiver 64 in the up-and-down, and right-and-left direction (in any diametrical direction with the spring 65 as the center). Accordingly, a relative movement between the developing casing 22 and the contact part 66 in a direction substantially parallel to the left side wall 30 is permitted. The contact part 66 is urged in a direction substantially orthogonal to the left side wall 30, namely, from the right inside to the left outside, by the elasticity of the spring 65.

1-2) Conductive Plate

The conductive plate 63 is formed of a conductive material into a plate shape, and is provided on the surface of the left side wall 30 as shown in FIG. 3. The developing roller shaft 38 passes through the rear end part of the conductive plate 63, the supply roller shaft 36 passed through a midway part of the conductive plate 63 in the front and rear direction, and the spring receiver 64 is in contact with the front end part of the conductive plate 63. The developing roller shaft 38, the supply roller shaft 36 and the spring receiver 64 are electrically connected to the conductive plate 63.

2) Drum Cartridge

As shown in FIGS. 5 and 6, the drum casing 24 includes a drum guide section 71 for guiding the developing casing 22 into the developing cartridge accommodating section 50, an electrode fixing hole 76 (an example of an engagement portion) for positioning the developing electrode section 62, and a pair of plate spring members 95 (see FIG. 2, an example of urging means) for pressing the developing casing 22 toward the rear.

2-1) Drum Guide Section

The drum guide section 71 includes a shaft guide part 72 (an example of a second guide part) for guiding the developing casing 22 into the developing cartridge accommodating section 50, and an electrode guide part 73 (an example of a first guide part) for guiding the developing electrode section 62 to the electrode fixing hole 76 (described later).

a) Shaft Guide Part

The shaft guide part 72 is formed in each of the side walls 47 of the drum casing 24, is located at the rear of the developing cartridge accommodating section 50 as shown in FIG. 5. The shaft guide part 72 includes a guide start groove 74 in the form of a wide notch extending downward from the upper edge of the side wall 47, and a guide end groove 75 in the form of a narrow notch extending rearward from the lower end part of the guide start groove 74.

The guide start groove 74 extends in the up and down direction, and the lower end part of the guide start part 74 corresponds in location to a position of the drum shaft 52 in the up and down direction. The guide end groove 75 extends in the front and rear direction continuously from the lower end part of the guide start groove 74. The rear end part of the guide end groove 75 is located at a position rearward beyond a position of the developing roller shaft 38 kept in contact with the photoconductive drum 43.

b) Electrode Guide Part

The electrode guide part 73 is formed in the left side wall 47 of the drum casing 24, and is located at the center of the developing cartridge accommdating section 50 in the front and rear direction. The electrode guide part 73 is disposed in front of the guide start groove 74 such that the electrode guide part 73 is spaced apart from the guide start groove 74 correspondingly to a distance between the developing roller shaft 38 and the developing electrode section 62.

As shown in FIG. 5, the electrode guide part 73 extends downward from the upper edge of the left side wall 47 to the electrode fixing hole 76 (described later). As shown in FIG. 6, the electrode guide part 73 is protruded from the left side wall 47 toward the left side, and presents a substantially "]" shape as viewed in a plan view. The electrode guide part 73 extends in the up and down direction, and has a substantially trapezoidal shape as viewed in a side view such that the lower end part of the electrode guide part 73 is narrower than the upper end part thereof. The electrode guide part 73 is formed as a part of the left side wall 47 to define a groove, the upper and lower end parts of which are open.

2-2) Electrode Fixing Hole

The electrode fixing hole 76 is provided for allowing the contact part 66 to be inserted when the developing cartridge 21 is mounted in place to the drum cartridge 20, thereby exposing the contact part 66 to the left outside from the left side wall 47.

The electrode fixing hole 76 is disposed below the electrode guide part 73 in the left side wall 47. The electrode fixing hole 76 is formed as a through hole which passes through the left side wall 47 and which has a substantially U-shape as viewed in a side view such that a lower end part of the electrode fixing hole 47 is curved. The lower edge of the electrode fixing hole 76 corresponds in location to a position of the lower edge of the guide end groove 75 in the up and down direction. The length of the electrode fixing hole 76 in the up and down direction corresponds to the length of the contact part 66 in the up and down direction.

2-3) Plate Spring Member

The plate spring members 95 are provided on respective right and left end parts of the front wall of the drum casing 24. Each of the plate spring members 95 has a substantially inverted-V shape in cross section. The front piece of the plate spring member 95 is fixed to the rear face of the front wall of the drum casing 24, and the rear piece thereof is supported by the front piece thereof so as to be elastically deformable in the front and rear direction.

3) Attachment and Detachment of Developing Cartridge to and from Drum Cartridge 3-1) Attachment of Developing Cartridge to Drum Cartridge When the developing cartridge 21 is to be attached (mounted) to the drum cartridge 20, first the gripper 23 is gripped and the developing casing 22 is placed above the developing cartridge accommodating section 50 in such an inclined state that the rear of the developing casing 22 is oriented downward, as indicated by one-dotted chain line in FIG. 7. Next, the developing roller shaft 38 is inserted into the guide start groove 74 from above and the developing electrode section 62 is inserted into the electrode guide part 73 from above.

The developing roller shaft 38 is guided by the guide start groove 74 to the lower end part of the guide start groove 74 in the up and down direction. While the contact part 66 of the developing electrode section 62 is slidingly contacted with the inner wall face of the electrode guide part 73 by the urging force of the spring 65, the contact part 66 is guided by the electrode guide part 73 downward in the up and down direction.

Subsequently, when the front of the developing casing 22 is swung downward with the rear thereof as a fulcrum as indicated by the arrow, the developing roller shaft 38 is inserted into the guide end groove 75 from the front and the developing electrode section 62 is inserted into the electrode fixing hole 76 from above.

Accordingly, the developing roller shaft 38 is guided by the guide end groove 75 in the front and rear direction until the rubber roller 39 comes in contact with the drum base 51. In this state, the developing roller shaft 38 is located at a midpoint of the guide end groove 75 in the front and rear direction (see solid line in FIG. 7).

Concurrently, the slope surface 69 of the contact part 66 of the developing electrode section 62 is brought into sliding contact with the upper edge of the electrode fixing hole 76 of the drum casing 24, and when the developing electrode section 62 is opposed to the electrode fixing hole 76, the contact part 66 urged toward the electrode fixing hole 76 by the spring 65 is inserted into and engaged with the electrode fixing hole 76 as shown in FIG. 8. Consequently, the contact part 66 is fixed to the electrode fixing hole 76 in such a state that the contact part 66 is exposed from the electrode fixing hole 76 and protruded from the electrode guide part 73 to the left in the right and left (see solid line in FIG. 7).

This way, the developing cartridge 21 can be mounted in place to the drum cartridge 20. In this state, the front wall of the developing casing 22 is pressed toward the rear by the plate spring members 95 so that the developing roller 28 and the photoconductive drum 43 are pressed against each other uniformly over the right and left direction (axial direction).

In this state, a movement of the developing roller shaft 38 along the guide end groove 75 in the front and rear direction is permitted, and while the contact part 66 is positioned in and fixed to the electrode fixing hole 76, a movement of the contact part 66 relative to the developing casing 22 is permitted because of flexibility of the spring 65. Thus, the developing casing 22 is disposed in the developing cartridge accommodating section 50 so as to be movable relative to the contact part 66 in the front and rear direction.

3-2) Detaching of Developing Cartridge from Drum Cartridge

When the developing cartridge 21 is to be detached from the drum cartridge 20, first the developing gripper 23 is gripped and the front of the developing casing 22 is swung upward with the rear thereof as a fulcrum.

The contact part 66 is moved upward so that the slope surface 69 of the contact part 66 is brought into sliding contact with the upper edge of the electrode fixing hole 76 of the drum casing 24. The contact part 66 is retreated toward the right inside against the urging force of the spring 65, and the contact part 66 is disengaged from the electrode fixing hole 76. The developing roller shaft 38 is guided by the guide end groove 75 to the lower end part of the guide start groove 74 toward the front in the front and rear direction.

Subsequently, the developing casing 22 is lifted upward in an inclined state in which the rear is oriented downward.

Then, while the contact part 66 of the developing electrode section 62 is slidingly contacted with the inner wall face of the electrode guide part 73 by the urging force of the spring 65, the developing electrode section 62 is guided upward in the up and down direction to the upper end part of the electrode guide part 73 and thereafter the developing electrode section 62 is released from the electrode guide part 73. The developing roller shaft 38 is guided by the guide start groove 74 upward in the up and down direction to the upper end part of the guide start groove 74, and thereafter the developing roller shaft 38 is released from the guide start groove 74.

This way, the developing cartridge 21 can be detached from the drum cartridge 20.

4) Apparatus Casing

As shown in FIG. 9, the apparatus casing 2 includes the process unit accommodating section 77 (an example of a second accommodating section) for accommodating the drum casing 24 therein, apparatus side plates 90 respectively provided on right and left sides of the process unit accommodating section 77, and process unit guide units 91 respectively provided the apparatus side plates 90.

The process unit accommodating section 77 is provided within the internal space of the apparatus casing 2, and can be accessed from the exterior by opening the front cover 5 (see also FIG. 1). The process unit accommodating section 77 is partitioned in the internal space of the apparatus casing 2, and is located below the scanner unit 14 and above the feeder section 3.

The apparatus side plates 90 partitions the right and left sides of the process unit accommodating section 77. The apparatus side plates 90 also supports the right and left sides of the scanner unit 14.

The process unit guide units 91 are respectively provided on the inner side faces of the apparatus side plates 90. Each of the process unit guide unit 91 has an apparatus guide section 78 for guiding the process unit 15 to be attached to and detached from the apparatus casing 2. One of the process unit guide unit 91, the left guide unit 91 in this example, has an apparatus electrode 79 (an example of a second electrode or an electrode on the apparatus side) for inputting a developing bias to the contact part 66.

4-1) Apparatus Guide Section

The apparatus guide section 78 includes an upper guide groove 80 and a lower guide groove 81 as shown in FIG. 9.

a) Upper Guide Groove

The upper guide groove 80 is provided in each of the process unit guide units 91, and is located above a central portion of the apparatus casing 2 in the up and down direction. The upper guide groove 80 extends from the front edge of the apparatus casing 2 toward the rear in the front and rear direction to be slightly inclined downward.

A drum shaft guide section 83 extends continuously from the upper guide groove 80 so as to guide the drum shaft 52 to a mounted position. The drum shaft guide section 83 is narrow, and extends beyond a contact guide section 82 (described later) rearward in the front and rear direction. The drum shaft guide section 83 is inclined downward.

A stopper spring 84 for retaining the drum shaft 52 at the mounted position is provided at the rear end part of the drum shaft guide section 83.

One of the process unit guide unit 91, the left guide unit 91 in this example, has the contact guide section 82. The contact guide section 82 is formed in the lower part of the upper guide groove 80 so as to guide the contact part 66 to the apparatus electrode 79. The contact guide section 82 is inclined downward to a midpoint of the upper guide groove 80 in the front and rear direction, and is largely recessed downward at the midpoint of the upper guide groove 80 to present an arcuate shape.

b) Lower Guide Groove

The lower guide groove 81 is provided in each of the process unit guide units 91 and is located in the central portion of the apparatus casing 2 in the up and down direction to be spaced apart from the upper guide groove 80 in the up and down direction. The lower guide groove 81 extends in the front and rear direction to be substantially parallel to the upper guide groove 80. The lower guide groove 81 is slightly inclined downward from the front edge of the apparatus casing 2 toward the rear.

The rear end part of the lower guide groove 81 is located above the lower registration roller 10, and is located at the substantially same position as the rear end part of the contact guide section 82 in the front and rear direction. The rear end part of the lower guide groove 81 has a press spring 85 for urging the upper registration roller 11 toward the lower registration roller 10.

4-2) Apparatus Electrode

The apparatus electrode 79 is provided in one of the process unit guide unit 81, the left guide unit 91 in this example. The apparatus electrode 79 is disposed at the rear end part of the contact guide section 82 in the process unit accommodating section 77.

A pin 86 is provided below the rear end part of the contact guide section 82. The pin 86 projects from the left apparatus side plate 90 to the left outside.

The apparatus electrode 79 includes a winding part 87 in the form of a coil, and a contact part 88 continuous from the winging part 87 and extending in the tangential direction of the winding part 87.

The winding part 87 is press-fitted to the pin 86 so that the apparatus electrode 79 is supported on the pin 86. The contact part 88 is directed upright along the rear edge of the contact guide section 82.

A developing bias is applied to the apparatus electrode 79 from a high-voltage board (not shown) provided in the apparatus casing 2.

5) Attachment and Detachment of Process Unit to and from Apparatus Casing 5-1) Attachment of Process Unit in Apparatus Casing When the process unit 15 is to be attached (mounted) to the apparatus casing 2, first the front cover 5 is opened and the process unit accommodating section 77 is exposed as shown in FIG. 9.

Next, the gripping part 25 is gripped, and the process unit 15 is placed in front of the process unit accommodating section 77. Thereafter, the drum shaft 52 and the contact part 66 are inserted into the upper guide groove 80 from above, and the upper registration roller 11 is inserted into the lower guide groove 81 from above. Subsequently, the process unit 15 is pushed toward the rear. As shown in FIGS. 10 and 11, the drum shaft 52 is guided by the drum shaft guide section 83 to the rear end part of the drum shaft guide section 83 in the front and rear direction. The contact part 66 is guided by the contact guide section 82 to the rear end part of the contact guide section 82 in the front and rear direction. The upper registration roller 11 is guided by the lower guide groove 81 to the rear end part of the lower guide groove 81 in the front and rear direction.

When the drum shaft 52 climbs over the stopper spring 84, the drum shaft 52 is pressed against the rear end part of the drum shaft guide section 83 by the urging force of the stopper spring 84 as shown in FIG. 11. This way, the drum shaft 52 can be fixed at the mounted position.

When the contact part 66 is guided to a position confronted with the apparatus electrode 79, the apparatus electrode 79 comes in contact with the contact face 70 of the contact part 66 from the rear (photoconductive drum 43 side) (see FIG. 12).

When the upper registration roller 11 is guided to the rear end part of the lower guide groove 81, the upper registration roller 11 is urged downward by the press spring 85 to be pressed against the lower registration roller 10.

This way, the process unit 15 can be mounted to the apparatus casing 2. Thereafter, the front cover 5 is closed so that the process unit accommodating section 77 is closed.

During development, the developing bias applied from the high-voltage board to the apparatus electrode 79 is applied through the contact part 66, the spring 65, the spring receiver 64 and the conductive plate 63 to the developing roller shaft 38 and the supply roller shaft 36.

5-2) Detaching of Process Unit from Apparatus Casing

When the process unit 15 is to be detached from the apparatus casing 2, first the front cover 5 is opened and the process unit accommodating section 77 is exposed as shown in FIG. 11.

Next, the gripping part 25 is gripped and the process unit 15 is drawn out to the front. The drum shaft 52 climbs over the stopper spring 84 and is guided by the drum shaft guide section 83 to the front end part of the drum shaft guide section 83 in the front and rear direction as shown in FIG. 10. The contact part 66 is forwardly moved away from the apparatus electrode 79, and is guided by the contact guide section 82 to the front end part of the contact guide section 82 in the front and rear direction according to. The upper registration roller 11 is released from the press spring 85, and is guided by the lower guide groove 81 to the front end part of the lower guide groove 81 in the front and rear direction.

Thereafter, the drum shaft 52 and the contact part 66 are removed from the upper guide groove 80, and the upper registration roller 11 is removed from the lower guide groove 81.

This way, the process unit 15 can be detached from the apparatus casing 2.

3. Function and Advantages for Application of Developing Bias

1) When the developing cartridge 21 is mounted to the drum cartridge 20, the contact part 66 is inserted into the electrode fixing hole 76 by the urging force of the spring 65 and is positioned in the electrode fixing hole 76. On the other hand, the developing roller shaft 38 is permitted to move in the front and rear direction along the guide end groove 75, and a relative movement of the contact part 66 to the developing casing 22 is permitted because of flexibility of the spring 65. Thus, the developing casing 22 can be disposed in the developing cartridge accommodating section 50 to be movable relative to the contact part 66 in the front and rear direction.

Consequently, even if vibrations are generated due to rotation of the photoconductive drum 43 during image formation, the developing casing 22 can be moved in the front and rear direction relative to the drum casing 24 to follow and absorb the vibrations. On the other hand, since the contact part 66 is positioned in and fixed to the electrode fixing hole 76, the movement of the developing casing 22 relative to the drum casing 24 in the front and rear direction does not affect the fixed position of the contact part 66, and the contact of the contact part 66 with the apparatus electrode 79 at the fixed position can be maintained. Thus, the developing bias can be stably supplied.

2) When the developing cartridge 21 is mounted to the drum cartridge 20, the slope surface 69 of the contact part 66 is brought into sliding contact with the upper edge of the electrode fixing hole 76 of the drum casing 24. Thus, the contact part 66 can be engaged with the electrode fixing hole 76 reliably in the up and down direction.

When the developing cartridge 21 is detached from the drum cartridge 20, the slope surface 69 is brought into sliding contact with the upper edge of the electrode fixing hole 76 of the drum casing 24. Thus, the engagement of the contact part 66 with the electrode fixing hole 76 can be released reliably in the up and down direction. In particular, since the slope surface 69 is formed in the tip insertion part 67, the engagement of the contact part 66 with the electrode fixing hole 76 and the disengagement of the contact part 66 from the electrode fixing hole 76 can be ensured reliably.

3) Since the contact face 70 is formed in the base end contact part 68 of the contact part 66 to have a constant outer diameter, a contact area between the contact part 66 and the apparatus electrode 79 can be made constant, and can be arranged on a continuous straight line L2 as viewed in the front and rear direction. Thus, reliable contact between the contact part 66 and the apparatus electrode 79 can be ensured. Consequently, the bias can be stably supplied. Since the contact face 70 is configured to receive contact pressure of the apparatus electrode 79 in a direction perpendicular to the urging direction of the spring 65, the contact pressure of the apparatus electrode 79 on the contact face 70 does not cause a force of component that pushes the contact part 66 against the urging force of the spring 65. Therefore, even if the contact pressure of the apparatus electrode 79 is made larger, the contact part 66 is prevented from being displaced and removed from the electrode fixing hole 76, and more reliable contact between the contact part 66 and the apparatus electrode 79 can be ensured. Since the contact face 70 is defined as a surface which contains the imaginary straight line L1 parallel to the urging direction of the spring 65, the apparatus electrode 79 can come in contact with the contact face 70 at any point existing on the imaginary straight line L1 even if the contact part 66 is slightly offset in the urging direction of the spring 65. Therefore, reliable contact between the contact part 66 and the apparatus electrode 79 can be ensured.

4) Further, the spring 65 is formed of a conductive material, so that the developing bias can be applied reliably to the developing roller 28.

5) When the developing cartridge 21 is mounted to the drum cartridge 20, the contact part 66 is guided to the electrode fixing hole 76 along the electrode guide part 73. Thus, the engagement of the contact part 66 with the electrode fixing hole 76 can be ensured reliably.

6) The drum guide section 71 has the electrode guide part 73 and the guide start groove 74 that both extend in the up and down direction. Thus, the developing cartridge 21 can be mounted smoothly to the drum cartridge 20.

On the other hand, the guide end groove 75 extends in the front and rear direction to permit the developing roller shaft 38 to move in the front and rear direction, whereas the electrode fixing hole 76 is not elongated in the front and rear direction. Thus, even if the developing cartridge 21 is moved in the front and rear direction relative to the drum cartridge 20 to follow and absorb vibrations caused by rotation of the photoconductive drum 43 during image formation, the contact part 66 can be prevented from moving in the front and rear direction.

Accordingly, the developing cartridge 21 can be mounted smoothly to the drum cartridge 20, and further the contact part 66 can be fixed reliably in the electrode fixing hole 76 during image formation.

7) When the process unit 15 is mounted to the apparatus casing 2, the contact part 66 and the apparatus electrode 79 come in contact with each other in the front and rear direction, i.e. a direction in which the developing roller 28 and the photoconductive drum 43 are confronted with each other. Since the direction in which the developing roller 28 and the photoconductive drum 43 are confronted with each other is one of references used for positioning the process unit 15 relative to the apparatus casing 2, reliable contact between the contact part 66 and the apparatus electrode 79 can be ensured. In this connection, the axes of the developing roller 28, the photoconductive drum 43 and the contact part 66 in this example are aligned substantially on an imaginary straight line when the developing cartridge 21 is mounted to the drum cartridge 20.

8) In particular, the apparatus electrode 79 comes in contact with the contact part 66 from the rear (photoconductive drum 43 side). Thus, reliable contact between the contact part 66 and the apparatus electrode 79 can be ensured without hindering mounting of the process unit 15 to the apparatus casing 2.

4. Modified Examples 4-1) Modified Example of Contact Part

Figure 13:
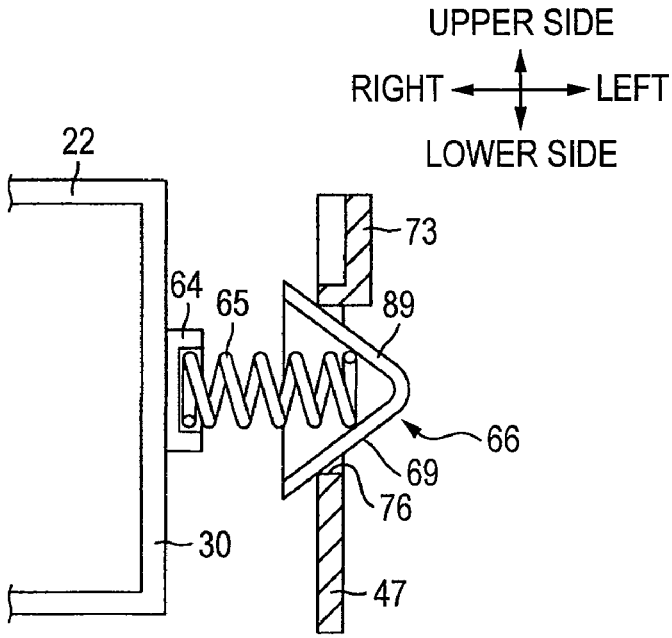
FIG. 13 is a sectional view, in a width direction, of a modified example of the process unit shown in FIG. 7 to show a developing electrode section and an electrode guide part.
Figure 14:
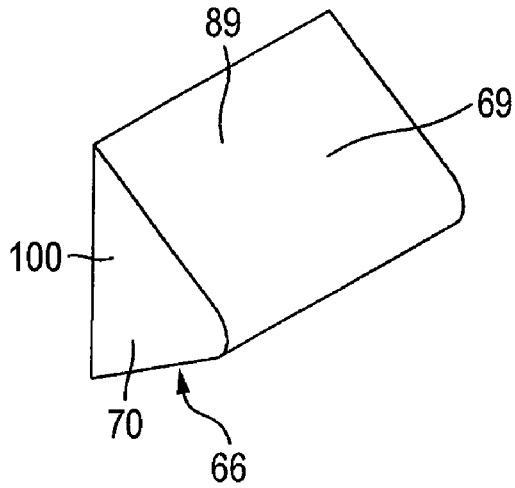
FIG. 14 is a perspective view of a contact part shown in FIG. 13.
Figure 15:
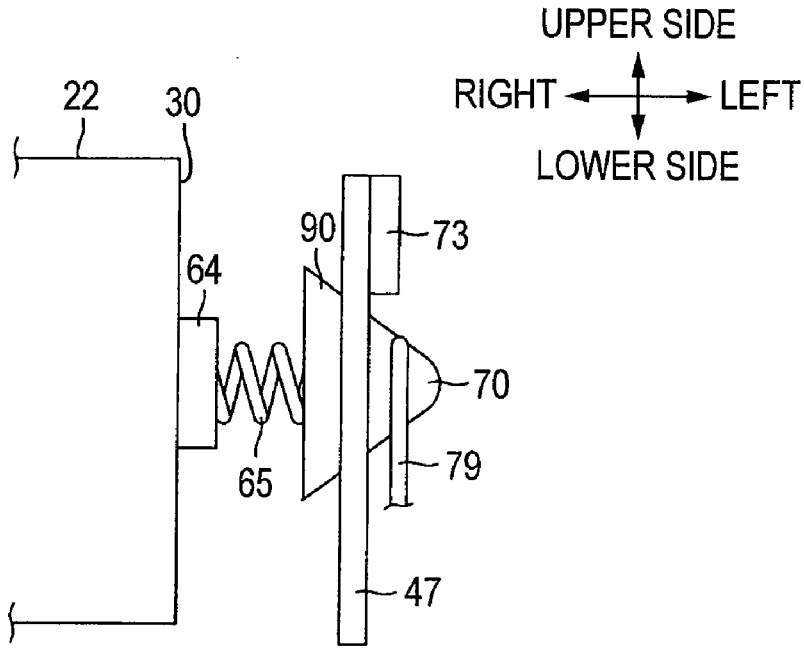
FIG. 15 is a rear view of the contact part and the apparatus electrode.

FIG. 13 is a sectional view, in a width direction, of the process unit shown in FIG. 7 to show a developing electrode section and an electrode guide part. FIG. 14 is a perspective view of a contact part shown in FIG. 13. FIG. 15 is a rear view of the contact part and an apparatus electrode. Members similar to those previously described with reference to the accompanying drawings are denoted by the same reference numerals in FIGS. 13 to 15 and will not be discussed again.

In the description given above, the contact part 66 is formed by the cylindrical base end contract part 68 and the hemispherical tip insertion part 67 to provide a substantially U-shape in cross section. As shown in FIG. 14, the contact part 66 can also be formed into a substantially triangular prism.

A contact part 66 includes an inclined wall 89 and flat walls 100 integral with the inclined wall 89. The inclined wall 89 has a substantially V-shape in cross section, and extends in the front and rear direction. Each of the flat walls 100 has a substantially triangle shape, and closes a respective one of front and rear end parts of the inclined wall 89. In this example, the surface of the inclined wall 89 functions as a slope surface 69, and the surface of the flat wall 100 functions as a contact face 70.

As shown in FIG. 13, a spring 65 is fixed to the inner wall of the inclined wall 89 of the contact part 66.

As shown in FIG. 15, the V-shaped slope surface 69 of the contact part 66 can be brought into contact with both sides of an electrode fixing hole 76 in the up and down direction (i.e., a direction orthogonal to both the urging direction of the spring 65 and the direction in which a developing roller 28 and a photoconductive drum 43 are confronted with each other). Thus, engagement of the contact part 66 with the electrode fixing hole 76 and disengagement of the contact part 66 from the electrode fixing hole 76 can be ensured reliably. In this connection, in this example, not only the upper edge of the electrode fixing hole 76 but also the lower edge of the electrode fixing hole 76 is formed linearly, so that the electrode fixing hole 76 is defined as a rectangular through-hole. On the other hand, the contact face 70 of the wall 100 is flat and thus can be reliably brought into contact with a apparatus electrode 79.

In this example, the contact part 66 has a substantially triangle shape in cross section, but can also be formed to have a substantially semicircle shape in cross section, for example.

4-2) Modified Example of Image Formation Apparatus

In the description given above, the drum cartridge 20 is attached to and detached from the apparatus casing 2, but the drum cartridge 20 can also be integrated into the apparatus casing 2. In this case, the developing cartridge 21 can be attached to and detached from the drum cartridge 20 provided in the apparatus casing 2.

In the description given above, a monochrome laser printer is illustrated as an example of the image formation apparatus, but the image formation apparatus of the invention also includes a color laser printer. In this case, for example, a plurality of (for example, four) developing cartridges in which different color toners are stored are detachably mounted to one process unit. Alternatively, a plurality of (for example, four) developing cartridges in which different color toners are stored are detachably mounted to a plurality of (for example, four) process units in a one-to-one correspondence.

The present invention can provide the following illustrative, non-limiting embodiments:

(1) A process unit including: a first casing having a photoconductor on which an electrostatic latent image is formed; and a developing cartridge having a developer carrier for carrying a developer to develop the electrostatic latent image, the developing cartridge being detachably mounted to the first casing, wherein the first casing includes a first accommodating section for accommodating the developing cartridge so that the developer carrier is confronted with the photoconductor, the first accommodating section having a through hole in a direction intersecting a direction in which the developer carrier and the photoconductor are confronted with each other, and wherein the developing cartridge includes: a first electrode, engaged with and fixed to the through hole when the developing cartridge is accommodated in the first accommodating section, for inputting a bias to the developer carrier; a second casing for supporting the developer carrier, the second casing being placed in the first accommodating section movably relative to the first electrode in the direction in which the developer carrier and the photoconductor are confronted with each other when the developing cartridge is accommodated in the first accommodating section; and a joint member for joining the first electrode and the second casing and urging the first electrode toward the through hole when the developing cartridge is accommodated in the first accommodating section.

(2) The process unit according to (1), wherein the first electrode includes a slope surface inclined from the outside of the first electrode to the inside thereof as the slope surface goes in a direction from the upstream side in the urging direction of the joint member to the downstream side and the slope surface is located at least in the downstream side.

(3) The process unit according to (2), wherein the slope surface is provided on the first electrode in a direction orthogonal to both the urging direction of the joint member and the direction in which the developer carrier and the photoconductor are confronted with each other.

(4) The process unit according to any one of (1) to (3), wherein the first electrode includes a contact face containing a line along the urging direction of the joint member.

(5) The process unit according to any one of (1) to (4), wherein the joint member is formed of a conductive material.

(6) The process unit according to any one of (1) to (5), wherein the first casing is formed with a first guide section for guiding the first electrode to the through hole when the developing cartridge is mounted to the first casing.

(7) The process unit according to (6), wherein the first casing is formed with a second guide section for guiding the second casing to the first accommodating section when the developing cartridge is mounted to the first casing, wherein the second guide section is formed so that a direction when guide is started and a direction in which guide is terminated differ and the direction when guide is terminated becomes a direction along the direction in which the developer carrier and the photoconductor are confronted with each other, and wherein the first guide section is formed along the direction when the guide of the second guide section is started.

(8), An image formation apparatus including: a process unit including a first casing having a photoconductor on which an electrostatic latent image is formed, and a developing cartridge having a developer carrier for carrying a developer to develop the electrostatic latent image, the developing cartridge being detachably mounted to the first casing; and an apparatus casing to which the process unit is detachably mounted, wherein the first casing includes a first accommodating section for accommodating the developing cartridge so that the developer carrier is confronted with the photoconductor, the first accommodating section being formed with a through hole in a direction intersecting a direction in which the developer carrier and the photoconductor are confronted with each other, wherein the developing cartridge includes: a first electrode, engaged with and fixed to the through hole when the developing cartridge is accommodated in the first accommodating section, for inputting a bias to the developer carrier; a second casing for supporting the developer carrier, the second casing being placed in the first accommodating section movably relative to the first electrode in the direction in which the developer carrier and the photoconductor are confronted with each other when the developing cartridge is accommodated in the first accommodating section; and a joint member for joining the first electrode and the second casing and urging the first electrode toward the through hole when the developing cartridge is accommodated in the first accommodating section, and wherein the apparatus casing includes: a second accommodating section for accommodating the first casing; and a second electrode disposed in the second accommodating section and contacted with the first electrode.

(9) The apparatus according to (8), wherein the second electrode is confronted with the first electrode along the direction in which the developer carrier and the photoconductor are confronted with each other.

(10) The apparatus according to (9), wherein the second electrode is confronted with the first electrode from the photoconductor side.

(11), A developing cartridge including: a developer carrier for carrying a developer; a second casing having a pair of side plates for supporting longitudinal end parts of the developer carrier; a first electrode for inputting a bias to the developer carrier; and a joint member for joining the first electrode and one of the side plates and urging the first electrode in a vertical direction to the one of the side plates, thereby joining the second casing and the first electrode relatively movably in a direction parallel to the one of the side plates.

(12) The developing cartridge according to (11), wherein the first electrode includes a slope surface inclined from the outside of the first electrode to the inside thereof as the slope surface goes in a direction from the upstream side in the urging direction of the joint member to the downstream side, and the slope surface is located at least in the downstream side.

(13) The developing cartridge according to (12), wherein the slope surface is provided on the first electrode in a direction orthogonal to the urging direction of the joint member.

(14) The developing cartridge according to any one of ((11) to (13), wherein the first electrode includes a contact face containing a line along the urging direction of the joint member.

(15) The developing cartridge according to any one of (11) to (14), wherein the joint member is formed of a conductive material.

In the illustrative, non-limiting embodiment of (1), when the developing cartridge is mounted to the first casing, the first electrode is engaged with the through hole of the first casing by the urging force of the joint member and is fixed. The second casing is placed in the first accommodating section so that the second casing can make a relative movement to the first electrode in the direction in which the developer carrier and the photoconductor are confronted with each other. Thus, when an image is formed, even if vibrations occur due to rotation of the photoconductor, the developing cartridge can be moved relative to the first casing to follow the vibrations. On the other hand, since the first electrode is positioned as the first electrode is engaged with the through hole and is fixed, even if the developing cartridge is moved relative to the first casing, the first electrode can be kept in contact with the apparatus electrode at a fixed position. Thus, the bias can be stably supplied.

In the illustrative, non-limiting embodiment of (2), when the developing cartridge is mounted to the first casing, the slope surface of the first electrode is brought into sliding contact with the edge of the through hole of the second casing. Thus, the first electrode can be engaged reliably with the through hole. When the developing cartridge is detached from the first casing, the slope surface is also brought into sliding contact with the edge of the through hole of the second casing. Thus, the engagement of the first electrode with the through hole can be released reliably.

In the illustrative, non-limiting embodiment of (3), in the first electrode, the slope is provided in the direction orthogonal to both the urging direction of the joint member and the direction in which the developer carrier and the photoconductor are confronted with each other. Thus, the engagement of the first electrode with the through hole and the disengagement of the first electrode from the through hole can be ensured reliably from the direction orthogonal to both the urging direction of the joint member and the direction in which the developer carrier and the photoconductor are confronted with each other.

In the illustrative, non-limiting embodiment of (4), since the contact face of the first electrode contains a line portion along the urging direction of the joint member, even if the contact pressure between the first electrode and the apparatus electrode is strong, it is unlikely that the first electrode is disengaged from the through hole, and therefore reliable contact between the first electrode and the apparatus electrode can be ensured. Consequently, the bias can be stably supplied.

In the illustrative, non-limiting embodiment of (5), the joint member is formed of a conductive material. Thus, the bias can be applied reliably to the developer carrier.

In the illustrative, non-limiting embodiment of (6), when the developing cartridge is mounted to the first casing, the first electrode is guided to the through hole along the first guide section. Thus, the reliable engagement of the first electrode with the through hole can be ensured.

In the illustrative, non-limiting embodiment of (7), the direction of the first guide section and the direction in which guide of the second guide section is started are the same direction. Thus, the developing cartridge can be smoothly placed in the first casing. On the other hand, the direction of the first guide section and the direction in which guide of the second guide section is terminated differ. This means that the direction of the first guide section differs from the direction in which the developer carrier and the photoconductor are confronted with each other. Thus, when an image is formed, even if the developing cartridge is moved relative to the first casing to follow vibrations caused by rotation of the photoconductor, the first electrode can be prevented from being moved along the first guide section. Consequently, while the developing cartridge can be mounted smoothly in the first casing, the first electrode can be fixed reliably in the through hole when an image is formed.

In the illustrative, non-limiting embodiment of (8), when the developing cartridge is mounted to the first casing, the first electrode is engaged with the through hole of the first casing by the urging force of the joint member and is fixed. The second casing is placed in the first accommodating section so that the second casing can make a relative movement to the first electrode in the direction in which the developer carrier and the photoconductor are confronted with each other. Thus, when the process unit is mounted to the casing and an image is formed, even if vibrations occur due to rotation of the photoconductor, the developing cartridge can be moved relative to the first casing to follow the vibrations. On the other hand, since the first electrode is positioned as the first electrode is engaged with the through hole and is fixed, even if the developing cartridge is moved relative to the first casing, the first electrode can be kept in contact with the second electrode at a fixed position. Thus, the bias can be stably supplied.

In the illustrative, non-limiting embodiment of (9), when the process unit is mounted to the casing, the first electrode and the second electrode come in contact with each other along the direction in which the developer carrier and the photoconductor are confronted with each other. Thus, reliable contact between the first electrode and the second electrode can be ensured.

In the illustrative, non-limiting embodiment of (10), the second electrode comes in contact with the first electrode from the photoconductor side. Thus, reliable contact between the first electrode and the second electrode can be ensured without hindering mounting of the process unit to the casing.

In the illustrative, non-limiting embodiment of (11), when the developing cartridge is mounted to the first casing, the first electrode is engaged with the first casing by the urging force of the joint member and is fixed. Thus, when an image is formed, even if vibrations occur due to rotation of the photoconductor and the developing cartridge is moved relative to the first casing to follow the vibrations, the first electrode is positioned as the first electrode is engaged with the first casing and is fixed. Accordingly, even if the developing cartridge is moved relative to the first casing, the first electrode can be kept in contact with the apparatus electrode at a fixed position. Thus, the bias can be stably supplied.

In the illustrative, non-limiting embodiment of (12), when the developing cartridge is mounted to the first casing, the slope of the first electrode is brought into sliding contact with the first casing. Thus, the first electrode can be engaged reliably with the first casing. When the developing cartridge is detached from the first casing, the slope is also brought into sliding contact with the first casing. Thus, the engagement of the first electrode with the first casing can be released reliably.

In the illustrative, non-limiting embodiment of (13), in the first electrode, the slope is provided in the direction orthogonal to the urging direction of the joint member. Thus, the engagement of the first electrode with the first casing and the disengagement of the first electrode from the first casing can be ensured reliably from the direction orthogonal to the urging direction of the joint member.

In the illustrative, non-limiting embodiment of (14), since the contact face of the first electrode contains a line portion along the urging direction of the joint member, even if the contact pressure between the first electrode and the apparatus electrode is strong, it is unlikely that the first electrode is disengaged from the first casing, and therefore reliable contact between the first electrode and the apparatus electrode can be ensured. Consequently, the bias can be stably supplied.

In the illustrative, non-limiting embodiment of (15), the joint member is formed of a conductive material. Thus, the bias can be applied reliably to the developer carrier.

What is claimed is:

1. A process unit comprising:

a first casing having a photoconductor on which an electrostatic latent image can be formed; and a developing cartridge having a developer carrier configured to carry a developer to develop the electrostatic latent image, the developing cartridge being detachably mountable to the first casing, wherein the first casing includes:

a first accommodating section configured to accommodate the developing cartridge so that the developer carrier is confronted with the photoconductor in a first direction, the first accommodating section having an engagement portion, and wherein the developing cartridge includes:

an electrode which enters the engagement portion in a second direction intersecting the first direction to be engaged with and fixed to the engagement portion when the developing cartridge is accommodated in the first accommodating section, and which is configured to input a bias to the developer carrier;

a second casing which supports the developer carrier, and which is movable relative to the electrode in the first direction when the developing cartridge is accommodated in the first accommodating section; and a joint member which joins the electrode to the second casing, and which urges the electrode toward the engagement portion when the developing cartridge is accommodated in the first accommodating section.

2. The process unit as claimed in claim 1, wherein the first electrode comprises a proximal portion and a distal portion extending from the proximal portion in a third direction in which the joint member urges the electrode, at least the distal portion comprises a slope surface, and the slope surface is inclined so that a peripheral length of the slope surface as defined in an imaginary plane orthogonal to the third direction is gradually decreased as the slope surface goes away from the proximal portion.

3. The process unit as claimed in claim 2, wherein the slope surface is provided on at least portions of the electrode, and the portions of the first electrode are opposed to each other in a fourth direction orthogonal to both the first and third directions.

4. The process unit as claimed in claim 1, wherein the electrode comprises a contact face containing an imaginary straight line parallel to the third direction.

5. The process unit as claimed in claim 1, wherein the joint member is formed of a conductive material.

6. The process unit as claimed in claim 1, wherein the first casing comprises a first guide section which guides the electrode to the engagement portion when the developing cartridge is mounted to the first casing.

7. The process unit as claimed in claim 6, wherein the first casing comprises a second guide section which guides the second casing to the first accommodating section when the developing cartridge is mounted to the first casing, wherein the second guide section comprises a guide start portion extending in a fifth direction and a guide end portion extending in a sixth direction different from the fifth direction, and the sixth direction is different from the fifth direction and is substantially parallel to the first direction, and wherein a direction in which the first guide section extends is substantially parallel to the fifth direction.

8. An image formation apparatus comprising:

a process unit including a first casing having a photoconductor on which an electrostatic latent image can be formed and a developing cartridge having a developer carrier configured to carry a developer to develop the electrostatic latent image, the developing cartridge being detachably mountable to the first casing; and an apparatus casing to which the process unit is detachably mountable, wherein the first casing includes:

a first accommodating section configured to accommodate the developing cartridge so that the developer carrier is confronted with the photoconductor in a first direction, the first accommodating section having an engagement portion, wherein the developing cartridge includes:

a first electrode which enters the engagement portion in a second direction intersecting the first direction to be engaged with and fixed to the engagement portion when the developing cartridge is accommodated in the first accommodating section, which inputs a bias to the developer carrier;

a second casing which supports the developer carrier, and which is movable relative to the first electrode in the first direction when the developing cartridge is accommodated in the first accommodating section; and a joint member which joins the first electrode to the second casing, and which urges the first electrode toward the engagement portion when the developing cartridge is accommodated in the first accommodating section, and wherein the apparatus casing includes:

a second accommodating section configured to accommodate the first casing; and a second electrode, disposed in the second accommodating section, configured to contact the first electrode.

9. The image formation apparatus as claimed in claim 8, wherein the second electrode is confronted with the first electrode in the first direction when the first casing having the developing cartridge accommodated therein is accommodated in the second accommodating section.

10. The image formation apparatus as claimed in claim 9, wherein the second electrode is located between the first electrode and the photoconductor when the first casing having the developing cartridge accommodated therein is accommodated in the second accommodating section.

* * * * *

UNITED STATES PATENT AND TRADEMARK OFFICE

CERTIFICATE OF CORRECTION

PATENT NO. : 7,813,666 B2
APPLICATION NO. : 12/022401
DATED : October 12, 2010
INVENTOR(S) : Shougo Sato It is certified that error appears in the above-identified patent and that said Letters Patent is hereby corrected as shown below:

In Column 20, Claim 2, Line 54:
Please delete "first"

In Column 20, Claim 3, Line 65:
Please delete "first"

Signed and Sealed this
Fifteenth Day of November, 2011

David J. Kappos

David J. Kappos
*Director of the United States Patent and Trademark Office*